US008061404B2

(12) United States Patent
Neal et al.

(10) Patent No.: US 8,061,404 B2
(45) Date of Patent: Nov. 22, 2011

(54) MOLD FOR A BATTERY CAST ON STRAP

(75) Inventors: Robert W. Neal, Buffalo Grove, IL (US); Michael A. Garin, Mahtomedi, MN (US)

(73) Assignee: MarcTech Innovative Design, Inc., Buffalo Grove, IL (US)

( * ) Notice: Subject to any disclaimer, the term of this patent is extended or adjusted under 35 U.S.C. 154(b) by 185 days.

(21) Appl. No.: 12/623,417

(22) Filed: Dec. 18, 2009

(65) Prior Publication Data

US 2011/0146934 A1 Jun. 23, 2011

(51) Int. Cl.
*B22D 19/04* (2006.01)

(52) U.S. Cl. ..... 164/98; 164/109; 164/333

(58) Field of Classification Search ..... 164/98, 164/108–110, 332–334
See application file for complete search history.

(56) References Cited

U.S. PATENT DOCUMENTS

| | | | |
|---|---|---|---|
| 2,502,373 | A | 3/1950 | Galloway |
| 4,033,401 | A | 7/1977 | Wlodawer |
| 4,053,012 | A | 10/1977 | Farmer |
| 4,108,417 | A | 8/1978 | Simonton |
| 4,162,700 | A | 7/1979 | Kahn |
| 4,173,326 | A | 11/1979 | Oxenreider |
| 4,180,120 | A | 12/1979 | Eberle |
| 4,327,890 | A | 5/1982 | Cattano |
| 4,425,959 | A | 1/1984 | Mund |
| 4,573,514 | A | 3/1986 | Wolf |
| 4,729,542 | A | 3/1988 | Bechtold |
| 5,146,974 | A | 9/1992 | Mayer |
| 5,206,987 | A | 5/1993 | Mix |
| 5,308,719 | A | 5/1994 | Mrotek |
| 5,520,238 | A | 5/1996 | Hopwood |
| 5,776,207 | A | 7/1998 | Tsuchida |
| 6,119,762 | A | 9/2000 | Miyagi |
| 6,708,753 | B1 | 3/2004 | Brantley |
| 6,833,218 | B2 | 12/2004 | Mann |
| 7,082,985 | B2 | 8/2006 | Hopwood |
| 7,334,626 | B2 | 2/2008 | Hopwood |
| 2004/0154780 | A1 | 8/2004 | Fesert |
| 2009/0218069 | A1 | 9/2009 | Hopwood |

FOREIGN PATENT DOCUMENTS

| | | | |
|---|---|---|---|
| GB | 2023471 | A | 1/1980 |
| JP | 1195662 | A | 8/1989 |
| JP | 2002028769 | A | 1/1992 |

*Primary Examiner* — Kuang Lin
(74) *Attorney, Agent, or Firm* — Vangelis Economou; Economou IP Law

(57) ABSTRACT

A dual temperature mold assembly for maintaining a mold cavity used in a cast on strap process at two different temperatures facilitates the removal of the solidified strap after the molten metal is solidified. The mold assembly includes a mold cavity having walls attached to different mold assembly segments that are heated or cooled by thermal energy input and coolant processes which can maintain the mold cavities at different temperatures, so that molten metal around the battery plate lugs in a mold cavity segment is solidified while the sides of the mold cavity are exposed to at least one adjacent heated segment to provide thermal energy thereinto, resulting in a reduction of the amount of molten metal necessary for a cast on strap, and reducing the amount of thermal energy input into the process for manufacturing the straps.

13 Claims, 8 Drawing Sheets

MOLD FOR A BATTERY CAST ON STRAP

BACKGROUND OF THE INVENTION

1. Field of the Invention

This invention relates generally to battery strap and post cast-on machines, to batteries and systems and methods for manufacturing batteries, and more specifically to cast-on-strap (COS) configurations for increased efficiency and reduced energy usage in manufacturing electrical connections between plates within a multi cell battery and between the plates and the battery posts.

2. Background Art

Large batteries, for example, automobile and truck batteries, require special equipment and methods of manufacture. The process for proving electrical connections between the separate plates within the housing of a large battery and between the plate connection and the post that provides connection outside the battery housing is especially critical. Battery failure due to improper connections between plates, shorting within a battery housing, or even catastrophic failure can result in which pressure build-up can cause cell or housing to rupture and create environmental and safety hazards.

Additional considerations arise in providing an efficient and cost effective automated battery manufacturing process while also maintaining product reliability. An ideal process minimizes the material requirements and energy input during production, while simultaneously ensuring that the battery products diminish the risk of failure. While these attributes provide a goal for battery manufacturers to modernize battery production, the many previous attempts to provide for an optimum balance between efficiency and reliability have only provided incremental improvements, without adding significantly to the knowledge in the field.

Casting operations are usually accomplished simultaneously for all the cells of a battery being positioned in a mold having an inverted mirror image, but otherwise oriented as the cells would be in a finished battery cell structure. Stacked cell elements are clamped together with downwardly extending plate lugs adjacent to each other. Plural mold cavities, properly oriented to provide the desired strap shape, may be preheated. Molten metal, usually lead (Pb), or an alloy containing mostly lead, is available in and being continuously being circulated along a channel adjacent to the mold cavities. The lead or molten metal in the channel is preheated usually in a reservoir, usually located below the mold, and then pumped into the channel.

Upon reaching desired conditions, molten metal is pumped into the channel adjacent the mold until the level is raised to overflow weirs disposed between the channel and each mold cavity. The molten metal thus fills the mold cavities, after which the molten metal that has been pumped into the mold to a level above the weir is withdrawn, thereby to recede to a level below the top of the weir. Typically, the level of the molten metal in the channel is maintained between a predetermined set of parameters. When it is desired to overflow the weirs, it is raised to perhaps 12 mm above the level of the channel bottom, and when it is withdrawn, the level is about 6 mm above the channel bottom. Some systems require continuous circulation of the molten metal to and from the reservoir. Others simply raise the level to overflow into the mold cavities, and then pump make up molten metal form the reservoir to the channel.

The source of thermal energy is removed, and the cell plate assemblies, which are clamped in a desired orientation relative to each other, are positioned to immerse a portion of the plate connecting lugs on each plate into the molten mass in an appropriate connector strap mold cavity to provide a molten metal connection between the lugs. The cavities are then chilled, as by flowing water through one or more portions of the mold body, and contact of the chilled water with the mold cavity walls chills the molten lead so as to cause the molten lead to solidify. In most instances, the mold cavities are maintained at a constant temperature by a water jacket that selectively cools the mold cavities when needed, or when directed by thermocouples that monitor the mold temperature. Cooling of the molten metal solidifies the metal around the lugs. After the molded straps and posts solidify sufficiently, they are extracted from the mold with the lugs of the battery cell plates fused or welded to the metal (lead) straps, thereby generating the necessary electrical and mechanical connections therebetween.

For mass production, the above procedures are normally performed in repetitive cycles to provide for commercial efficiency. Cycle time, that is, the time from which the previous completed strap is removed to the time the next one is completed is ideally reduced to a minimum so that the maximum production is achieved in the time available. The efficiencies produced by providing optimal manufacturing parameters result from a number of contributing factors, including reduction of necessary labor, time and materials. It has been found that a substantial portion of the cycle time is involved in heating and cooling portions of the mold body. Reducing to a minimum the time that the lead must be maintained in a molten state reduces the total thermal energy input into the system. Also, if the amount of lead that must be heated to melting and then cooled is minimized, the thermal energy input and the cooling capacity is also reduced, leading to concomitant reductions in cycle time, cost of material, processing costs, etc.

The optimal production parameters provide that the channel walls should not be chilled to such a degree that the molten metal flow is impeded during welding, i.e., solidification or freezing, of the straps, tabs and posts. This allows the molten lead present in the flow channels adjacent the mold assembly to freely flow from the lead channels and into the mold cavity. A minimum degree of precision in the temperature control of the mold assembly is required to maintain the energy input to desirable levels. Nevertheless, cooling of the complete mold, including the weirs, causes the solidification of molten metal in unnecessary locations, as will be explained below. Greater control of localized temperature in the mold assembly is desirable so as to enable cooling of the posts, particularly the terminal posts, at least as rapidly as the less massive strap portions, since slower cooling of the posts would result in mechanically weak terminals.

Mold expense is a significant factor in machines of the type under consideration. It has been difficult to obtain suitable castings in which mold forms can be produced in greater mass quantities without sacrificing one of the other factors that go into the production process and system. This may result in increases of some costs, whether labor, material, energy or other costs, to enable improvements in other points in the process, for example, cycle time, amount of thermal energy input, etc. The variety of cell and terminal arrangements required for large lead-acid batteries has also complicated mold designs, to the detriment of the efficiencies that can be achieved by modifying one or more of the process parameters.

Prior art methods and systems for providing battery strap and post cast-on machines have been disclosed in, for example, U.S. Pat. Nos. 3,718,174 and 3,802,488 issued Feb. 27, 1973, and Apr. 9, 1974, respectively, both of which name as inventors Donald R. Hull and Robert D. Simonton.

Described therein are systems and machines, in which stacked battery plates and separators for a plurality of cells making up a lead-acid storage battery have the respective connection lugs for each of the positive and negative plates of each cell interconnected by a cast-on strap. Additionally, an inter-cell connecting or terminal post cast is provided for simultaneous casting in an integral portion of each strap. Conventional designs of this type are described above. The conventional types of molds require the complete mold, including the channel in which the molten metal is circulating to be heated and cooled, when the metal in the mold cavity is solidified. Heating of the complete mold assembly is very inefficient and leads to the waste of thermal energy in the form of heating and cooling the same elements in each cycle, both in terms of unnecessarily increasing cycle time and in terms of the amount of thermal energy expended in each cycle.

U.S. Pat. No. 4,108,417 describes and illustrates a system for pouring molten metal into mold cavities, where the mold portion that contains the mold cavities is partially isolated from the molten metal flow channel. That is, a thermal isolation technique is used wherein the mold cavity walls are isolated from the channel walls so as to provide a quicker cycle time and to permit the mold cavities to be heated quickly just before casting, and cooled when the lugs are placed into the mold cavities.

As shown in FIGS. 1-3, the mold assembly 100 (FIG. 3) includes and isolated portion 10 that is isolated from the flow channels (30, FIG. 3). The separate portion 10 of the mold assembly include the mold cavities 16, some of which may have separate flow chutes 34 (FIG. 3) that communicate with one or more mold cavities for terminal posts or other connections, for example tabs or tombstones, that attach the strap, after it is solidified, to the terminal post of the battery. An isolation member, usually some type of insulating material 15 is interposed between the mold cavity portion 10 and the rest of the mold assembly 100 so as to inhibit flow of thermal energy form the flow channel 30 to the mold cavity portion 10.

Separate flow chutes 34 between one or more of the mold cavities 12 and terminal post cavities 36 are provided for simultaneous casting of the battery terminal posts, thereby avoiding the separate and subsequent welding of terminal posts onto the cast on straps. As background, and to provide for a clearer understanding of the present invention, a more detailed explanation of the conventional methods as taught in various patents is provided.

U.S. Pat. No. 5,776,207 to Tsuchida et al., entitled "Lead acid storage battery and method for making same," describes and illustrates the use of a heating mechanism including an induction coil to provide instantaneous and accurate supply of thermal energy to the mold. It describes a problem, that is, the surface of the molten lead as it is cooled about the flanges or lugs of the plates does not solidify at a uniform state, and may result in strap "waves" when the lugs are removed from the mold. The induction coil heating is disclosed as providing an improvement in the temperature control to avoid structural problems in the strap configurations. Cooling is described as being provided to the underside surface of the mold by spraying of a coolant, such as water.

As shown in the cross-sectional views of FIGS. 4 and 5, the mold portion 10 provides for each mold cavity 12 to accommodate a plurality of plate lugs 44, 46 that extend downwardly form the separate plates 42. are FIG. 5 shows the plates 44 are each isolated from the adjacent plates 46 by an appropriate semi-permeable electrically insulating material 48, each adjacent plate pair 44, 46 comprising a battery cell. Plates 42, including the isolating material 48, are all clamped together by an appropriate clamp that surrounds the battery cell assembly and maintains the relative positions of the lugs in the desired orientation and position. The lugs 44 for the negative ion plates are adjacent one edge of the plate 42 while an adjacent plate that is positive during normal operation of the battery, so as to attract ions, is at the other edge of the adjacent plate. The mold cavities are appropriately positioned and oriented so that the negative plate lugs 44 all are able to fit into the cavity 12 of a negative lug mold 18 and positive plate lugs 44 all are able to fit into the cavity 12 of a positive lug mold 19 (FIG. 4). The molds are shown schematically to be isolated from the surrounding mold assembly by insulating material 15.

These are generally known methods of providing for isolation of a mold cavity portion of a mold assembly, and reference is made to U.S. Pat. Nos. 4,108,417 and 5,776,207 for teaching the methods. For a background understanding of the molten metal pouring method, and the elevation of the molten metal to a level greater than a gate level so that the molten metal is introduced into the mold cavities 12, reference is made to aforementioned U.S. Pat. No. 4,108,417, which illustrates and describes the generally known methods and supporting elements of a cast-on-strap mold system, such as a reservoir for molten metal, the supply of coolant and means for introducing thermal energy to the mold prior to the casting operation.

U.S. Pat. No. 6,708,753 entitled "Method and apparatus for casting straps onto storage battery plates" generally illustrates and describes the need for a substantial degree of precision of thermal conditions in pouring lead into a mold. It describes an automated process for inserting the lugs of a group of plates into plural mold cavities and injecting lead therein. The patent descries a need to sufficiently cool the mold cavities in order to solidify the lead strap metal prior to battery cell extraction.

U.S. Pat. No. 4,573,514, issued in 1984 and assigned to GNB Batteries Inc., is entitled "Electrically heatable mold and method of casting metal straps" and describes and illustrates a mold and automated method providing for precise control of the temperatures of the mold and lead pour on a continuous basis. Additional features include a tongue-in-groove connection between segments of a mold that have an intervening insulation material and a piston rod that is required to push the molded strap and post construction from out of the mold cavity. A forced air cooling method that cools the strap as soon as the plate tabs are immersed in the molten lead to form a connection between the metal elements, the cooling time being described as about thirty seconds or so. One improvement relates to isolating the cooling of the mold body to only a portion thereof so as to reduce the mass of the mold that requires cooling and subsequent reheating during each cycle. This feature is asserted as providing necessary temperature control for the disclosed process, and also includes a carousel arrangement for providing successive stages in the molding process at various points so that several processes may proceed on a continuous basis.

U.S. Pat. No. 5,836,371, issued in 1998 and assigned to GNB Batteries Inc., is entitled "Method and apparatus for attaching terminal post straps to a battery" and describes and illustrates a mold and method providing for welding the posts of a battery terminal onto the strap after the lugs are connected to each other electrically and mechanically using a plastic insert that is removed prior to the casting of the posts.

U.S. Pat. No. 7,082,985 to Hopwood entitled "Method and apparatus for casting straps onto storage battery plates" illustrates and describes the need for a substantial degree of precision in application of thermal conditions when pouring lead into a mold and further describes a known automated process for inserting the lead into the mold cavity.

What is needed is a mold cavity and process that can quickly and efficiently introduce into a mold cavity and solidify molten metal therein around the lugs of a group of clamped battery cell plates so as to cast on a strap that provides an increase in reliability and reduces the cycle time, as well as significantly reducing the amounts of lead used per cast and the amount of thermal energy that is input into the system for maintaining the metal in a molten state.

SUMMARY OF THE INVENTION

Significant features and distinct advantages provided by this invention include an improved mold assembly and process for casting battery straps that is efficient, has a rapid cycle time, and which drastically reduces thermal energy input per cast provided to the lead poured into the mold and for post cast-on machines and systems for providing these features. Additionally, the process for providing cast on straps made of lead or lead alloys in the mold is automated and reduces cycle time and amount of lead used in each strap. This results in an unexpected benefits in cast on strap manufacturing and in significant cost saving in time, material and labor costs per cast on strap manufactured using the inventive process in the device as illustrated and described below. There is provided a mold assembly, including a top surface, for casting cast on straps onto storage battery plates, having lugs along one edge thereof, the mold assembly comprising at least one mold cavity for receiving molten metal defined by a first operating temperature controlled segment at a first higher temperature and including a first mold cavity side wall, a second temperature controlled segment substantially defining a bottom mold cavity surface and opposed end walls of each mold cavity, and a third temperature controlled segment at a second operating higher temperature and including a second mold cavity side wall extending essentially vertically from the bottom surface of the bottom wall to a mold assembly top surface, and the temperature of the second temperature controlled segment being maintained at a lower temperature by a coolant jacket in contact with the material comprising the second temperature controlled segment and for providing cooling to the underside of the second segment bottom thereby to cool the bottom mold cavity surface and the opposed end walls, to solidify molten metal flowing in the mold cavity and between and around the lugs of the battery plates inserted into the mold cavity, a thermal energy input means for providing thermal energy to the first and third temperature controlled segments, including the first and second mold cavity side walls, to input at least a predetermined minimum amount of thermal energy into the mold cavity by exposure of the molten metal in the mold cavity at least to the first side wall of the first segment having a predetermined temperature higher than the temperature of the second segment.

The invention of broad scope comprising a partitioned lead Cast on Strap ("CoS") mold having a temperature differential at least in two, and preferably in three, parts of the mold assembly, the two side portions, referred to herein as the manifold segment and the central segment, are at elevated temperatures relative to the central segment. The manifold, and optionally the central segment, have a temperature control comprising a thermal energy input, to maintain these segments at a higher temperature level to maintain the metal in a molten state so the it can flow to the lugs of several battery plates and the mold cavity segment has a coolant jacket to cool the temperature of the mold between a temperature where the molten metal in the mold is maintained at a lower level to solidify the molten metal in the mold cavity to form the cast on strap. Ideally, each of the two segments, that is, the first manifold segment and the third, central segment, define at least one wall of the mold cavity so as to provide a thermal energy input into the mold cavity from the at least one wall, which has a higher temperature than the mold portion that is maintained throughout the cast-on-strap cycle. In a broad scope the inventive device and method includes at least one of the high temperature partitions being adjacent and defining the wall of the mold cavity. Additional features include the capability to provide a mold cavity having a smaller lead volume, a gate or weir structure that is maintained at a higher temperature because of its location in the first or manifold segment, permitting more efficient and cleaner flow over capability, as well as the ratios of the cavity exposed to the high temperature and relative to the low temperature partitions.

BRIEF DESCRIPTION OF THE DRAWINGS

The present invention will now be discussed in further detail below with reference to the accompanying figures in which.

DETAILED DESCRIPTION OF THE PREFERRED EMBODIMENTS

The conventional methods and configurations described above in relation to FIGS. 1-5 provide background for the invention as described below in greater detail. There may be common subject matter between the inventive mold assembly and those of the references be common subject matter between the inventive mold assembly and those of the references described above, and where there is overlap in the description or illustrations, those having knowledge of the battery cast-on strap equipment and process will understand that portions of the teachings of those references may be incorporated herein, where appropriate. For example, the conventional molten metal method of pumping molten metal in to upwardly exposed mold cavities, such as those described in U.S. Pat. No. 4,108,417, and the flow channel structure which may include similarities to the present invention, are to be considered as having been incorporated by reference.

Figure 6:
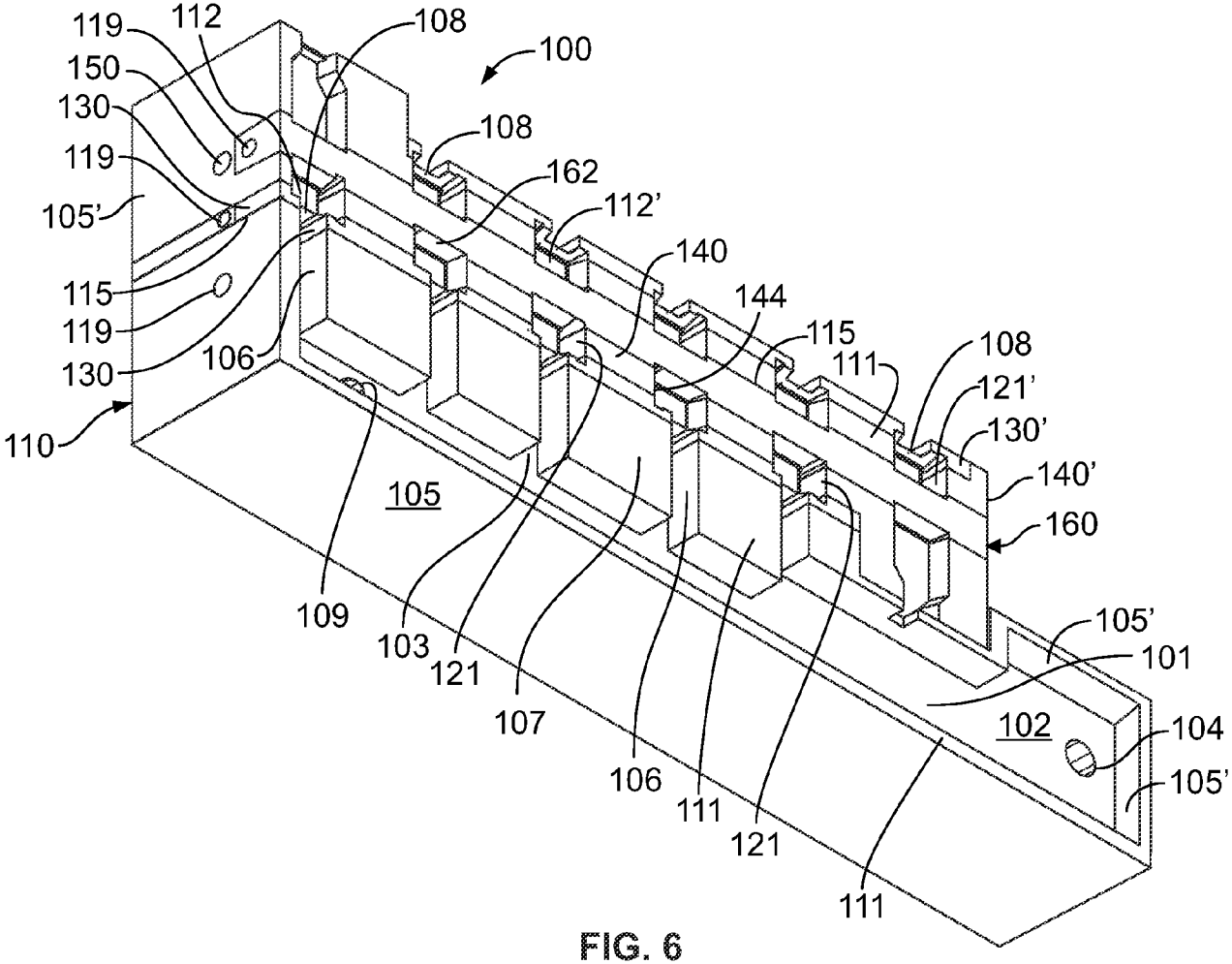
FIG. 6 is a perspective cutaway view of a mold assembly including the central area containing the mold cavities.
Figure 7:
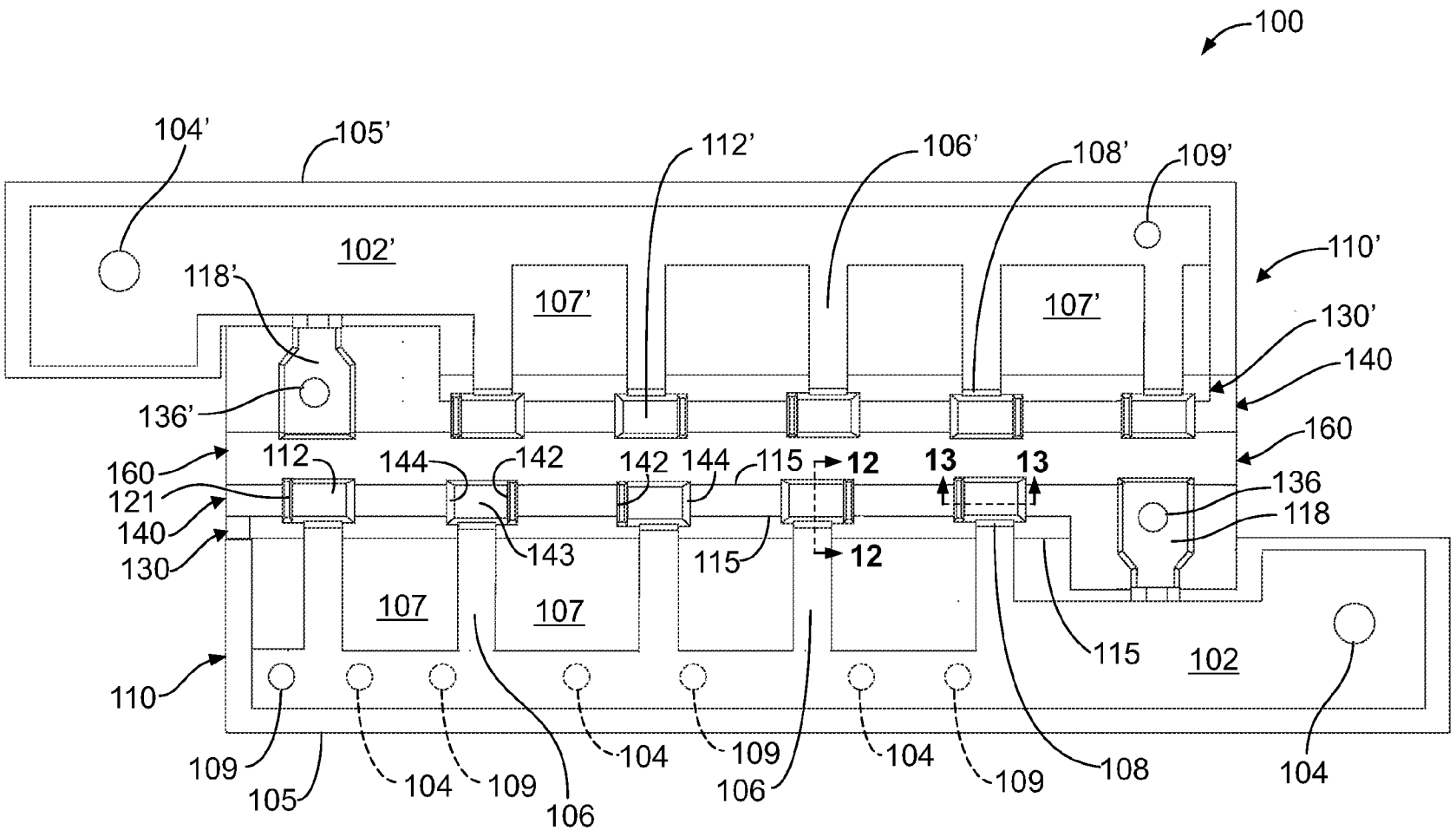
FIG. 7 is a plan view of the inventive mold assembly illustrated in FIG. 6.
Figure 8:
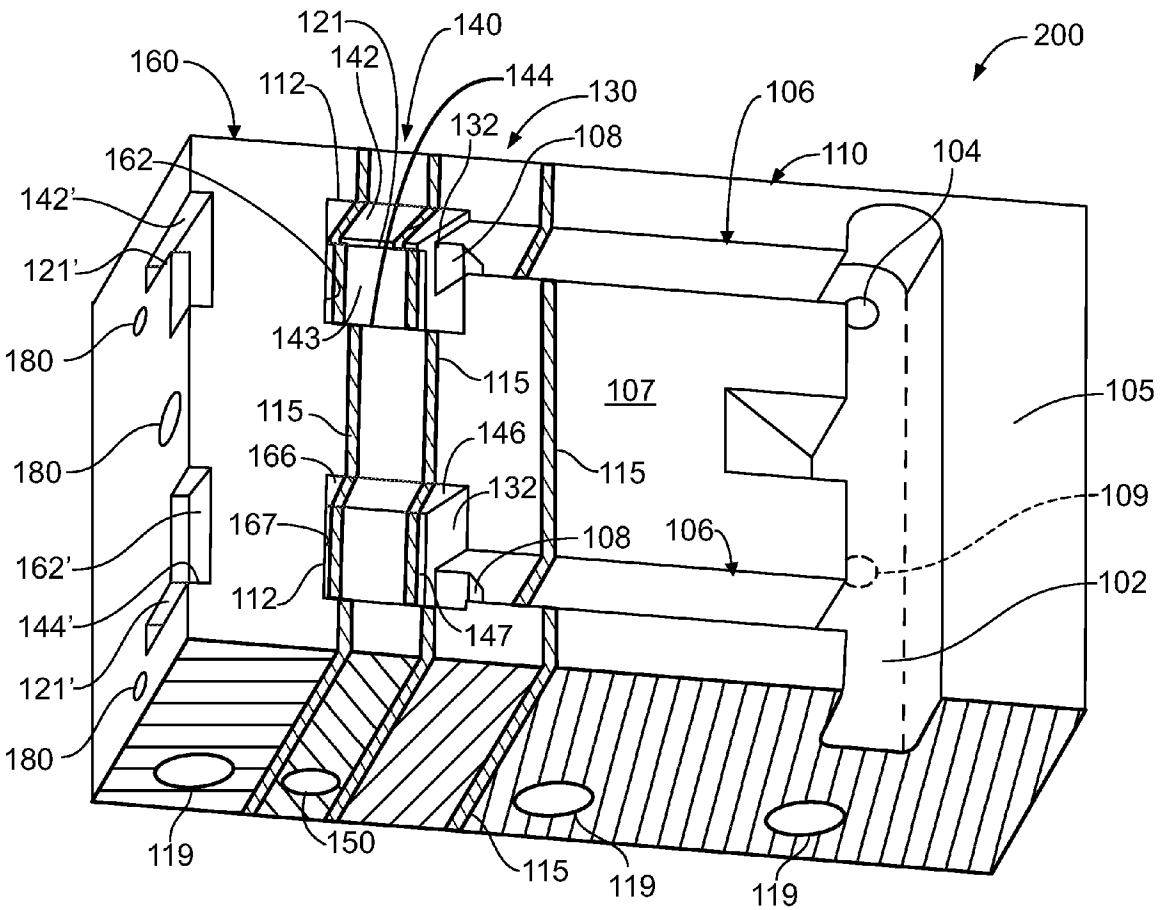
FIG. 8 is a cutaway detail view of a portion of the inventive mold assembly as shown in FIG. 6 to more simply and clearly illustrate the operation and several features of the invention.

A significant feature and distinct advantage is described in this application and by the mold configuration shown in FIGS. 6-8. Referring to FIGS. 6 and 7 in conjunction, FIG. 6 illustrates a perspective view of a central area of a mold assembly 100 and FIG. 7 shows a top plan view of the configuration of FIG. 6 with some additional elements shown to complete the structure. The mold assembly 100 is divided into several segments that extend longitudinally to define the central section, which is shown in FIG. 6 as a partial cross-section for purposes of more readily discernible illustration of the assembly. Some segments that would be present in a complete mold assembly 100 are not shown in FIG. 6, for example, the manifold segment 110' that is shown in FIG. 7.

FIG. 8 is a partially cutaway view of the more complete mold assembly 100 shown in FIGS. 6 and 7, but whereas the mold assembly shown in FIG. 6 is a perspective view of several mold cavities 112, 112', the detail cutaway view of FIG. 8 shows only two of the mold cavities 112 and a partial side wall portion of an adjacent mold cavity 112'. The depiction of the detail cutaway view in FIG. 8 simplifies the discussion below of the nature and significant inventive features of the mold cavity structure. However, since the cutaway is a simple schematic representation of the larger more complete mold assembly central section 110, the discussion herein also applies to the mold cavities shown in FIGS. 6 and 7, and indeed, to any other battery configuration that includes mold cavities utilizing the concepts of this invention.

Of the significant features of the invention is the opening of the side wall that is a part of the manifold segment 110 to define one side wall of the mold cavities 112, and the optional but preferred corresponding opening of the opposite side wall to another segment, the central segment 160 to permit the inflow of thermal energy into the mold cavity during the operation of the mold assembly to provide cast on straps. As shown in FIGS. 6 and 7, a plurality of mold cavities, 12 in total, are disposed in the upper surface of the mold assembly 100. The mold cavities 112, 112' provide a point of connection of the lugs of individual grids or plates of the battery cells, as shown with relation to the prior art cast on strap connections in FIGS. 4 and 5, described above. The lugs are welded together with lead or other molten metal as is known. Out of the 12 cavities, the mold assembly 100 also provides a specialized mold cavity 118 for the last in the line of mold cavities including a mold extension 136 to provide for the positive and negative battery posts. The lugs of each of the positive and negative grids or plates are welded within their respective cavities 112, for example, being arrayed for the positive plates and mold cavities 112' for the negative plates.

Figure 1:
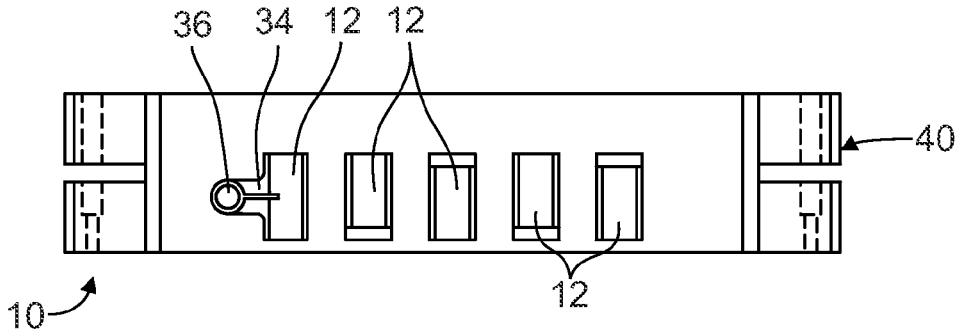
FIG. 1 PRIOR ART
FIG. 1 is a top plan view of a conventional mold assembly structure including a separate segment for containing the mold cavities.
Figure 2:
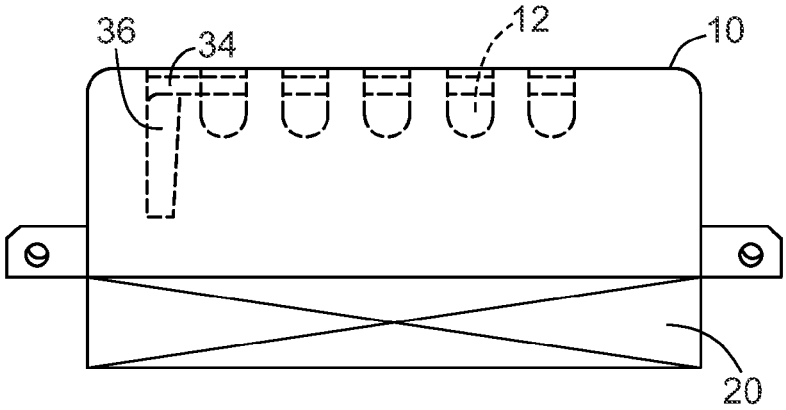
FIG. 2 PRIOR ART
FIG. 2 is a side view of the conventional mold assembly structure of FIG. 1.
Figure 3:
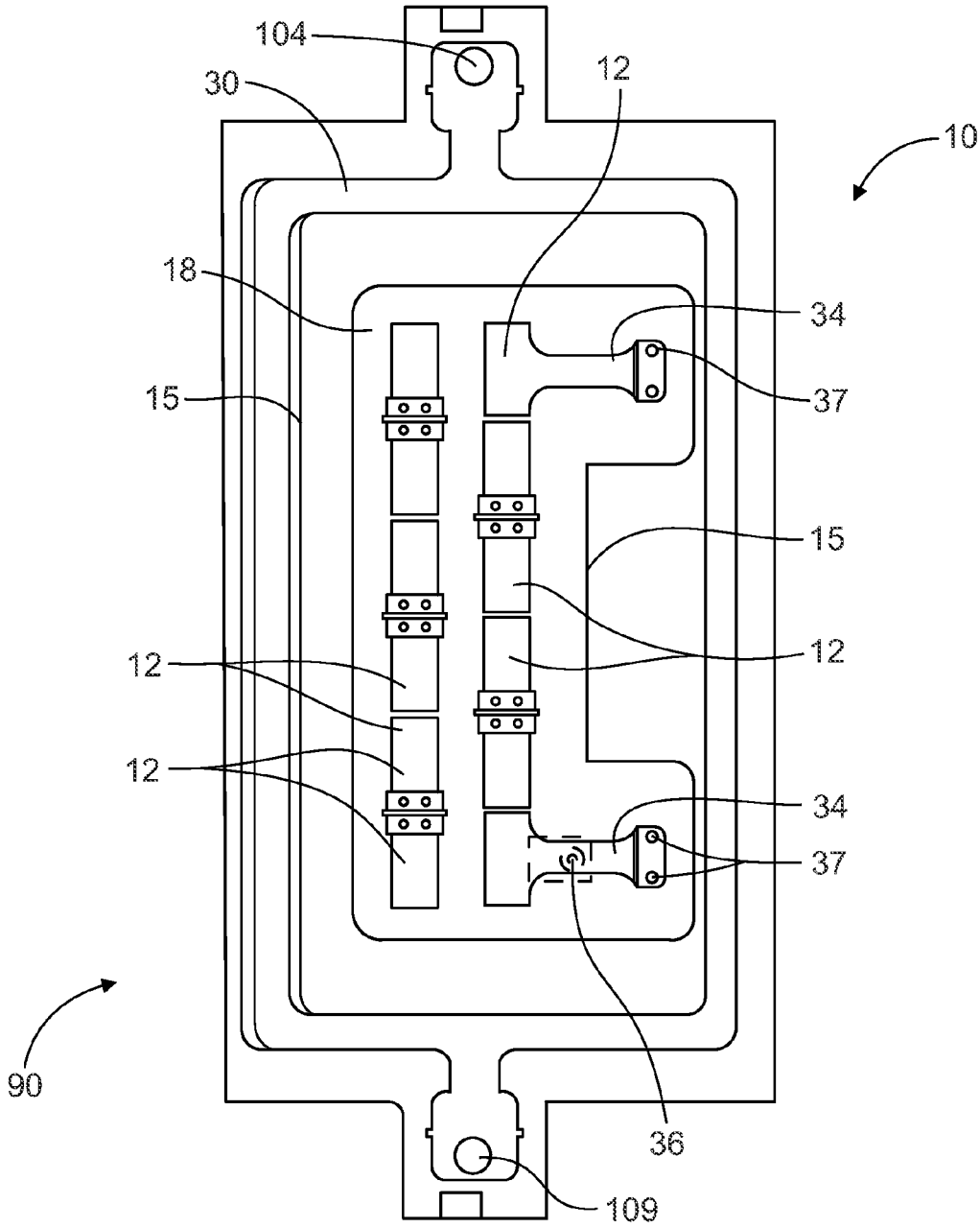
FIG.3 PRIOR ART
FIG. 3 top plan view of a conventional mold assembly structure including separate segments for containing the mold cavities and for containing the molten metal channel.

The mold assembly 100 in FIGS. 6 and 7 features the arrangement for a single vehicle battery using the inventive mold cavity structures. However, it is considered preferable and more efficient that the mold assembly include enough mold cavities 112, 112, for more than one battery. For example, the straps for two batteries may be simultaneously cast, which would utilize a structure having 24 mold cavities (not shown), four of which would include the battery post mold extensions in the mold assembly, such as is illustrated in FIG. 1 of U.S. Pat. No. 5,520,238. In this configuration, each mold would produce two separate plate structures to complete two batteries, although in some cases a manufacturer may opt to use a mold that produces only one battery. The present description is drawn to a structure for only one battery for the sake of simplifying the description, but the preferable method is to use a dual battery mold, as is known. Similarly, a carousel type arrangement known in the art, for example, as described in aforementioned U.S. Pat. No. 6,708,753, can be utilized but the inventive mold cavity structure may be used to include the inventive features described below to provide for a more efficient operation and for quicker cycle time.

FIG. 6 shows a manifold segment 110 that comprises at an upper surface an open top including a molten metal flow channel 102 to provide molten metal to a first row of mold cavities 112. FIG. 6 does not show a corresponding manifold having similar structure at the rear side of the mold assembly 100 for providing the same function to a second row of mold cavities 112' disposed on the opposite side form the first mold cavities 112 and separated by the central segment 160. However, this second molten metal flow delivery channel 110' is shown in the plan view of FIG. 7, since the mold configuration adjacent the central segment 160 is considered an important and significant part of the present invention herein. Nevertheless, it should be understood that such a manifold segment (not shown in FIG. 6) would be present on the back side of the mold assembly 100, which is shown in FIG. 7, so as to provide the same function to the second row of positive electrode mold cavities 112' as the flow channel 102 provides to the first row negative electrode mold cavities 112.

For purposes of this invention, the manifold segment 110' (FIG. 7) including its structure and operation may be considered to be essentially identical to the manifold segment 110 described below. Of course, possible modifications or alterations may be made to the mold structure to accommodate specific types of battery configurations, still utilizing the concepts described herein. One such modification may include the molten metal fluid inlet 104 at the same longitudinal end of the flow channel 102, rather than at opposite ends as shown in FIG. 7, so as to have a common manifold access to the molten metal reservoir (not shown). The second manifold segment could be similar to a mirror image of the mold assembly segment 110, but need not be a complete mirror image thereof, as is shown in FIG. 7. Other possible battery configurations may be contemplated that would require different mold assembly and flow channel structures, and these are contemplated to be encompassed by the present invention, even though the actual mold assembly structure maybe different from the one that may be contemplated for the present mold assembly structure.

Referring now to FIGS. 6 and 7, molten metal, such as lead or a lead alloy as is known in the art, generally is introduced into the flow channel 102 through the molten metal fluid inlet 104 and flows along the flow channel 102. A trough is defined by the outer wall 105 and a series of walls defined by islands 107 disposed along the opposite edge of the manifold segment 110 from the wall 105, and other outer wall portions 105' found at the longitudinal ends further define the flow channel 102. Between the islands 107, there are a plurality of flow chutes 106 that each terminate at gates or weirs 108, separating the flow chutes 106 from the mold cavities 112. The weirs 108 open onto each modular mold cavity 112 in the manifold segment 110 and similarly for the mold cavities 112' in mold segment 110'. Since the structure and operation of the two separate mold segments 110 and 110' are virtually identical, the discussion will be limited to that of the segment 110 shown in both FIGS. 6 and 7, it being understood that the discussion also can be applicable to the mold segment 110'. The flow channel 102 also includes a corresponding molten metal outflow port 109 disposed at a longitudinally opposite end in the flow channel 102 from the fluid inlet 104.

The outer walls 105, 105' and the islands 107 each extends upwardly to a mold assembly upper surface 111, which may be in a common plane across the whole mold assembly, as shown. During normal operation, the flow channel 102 defines a trough that is formed for flow of molten metal from the fluid inlet 104 toward the outflow port 109. Thus, any molten metal contained within the flow channel 102 will flow through the trough defined by the upright walls 105, 105' and islands 107 and continue to flow to the outflow port 109 where it can leave the channel 102. This configuration is desirable since it is necessary to control the level of molten metal in the flow channel 102 and flow chutes 106. Additionally, the configuration is desirable because continual circulation of the molten metal reduces anomalies and maintains the molten metal in a fluid state, since the outflow port 109 is connected to the reservoir (not shown) in which the molten metal temperature is maintained at a predetermined temperature.

The molten metal fluid inlet 104 of the channel 102 is controlled by a pump or other pouring mechanism that is capable of selectively increasing or decreasing the vertical level of the molten metal in the flow channel 102. The control mechanism may be a pump or other such device as is known in the art, for example, as described in aforementioned U.S. Pat. No. 4,108,417. The controls for the flow mechanism will be required to maintain the level of the molten metal well below the level of the mold assembly top surface 111 as defined by the outer walls 105, 105' and the islands 107. If the liquid level of the molten metal pumped into the flow channel 102 is sufficient to reach above a certain level, it will continue to flow laterally from the flow channel 102 and along the respective flow chutes 106 until it reaches up to the weirs 108.

Typically, the level of the molten metal is maintained at a lower level during the welding step, when the lugs are dipped into the molten metal. That is, the level of the molten metal may be maintained at a height of about 6 mm above the bottom surface 101 of the flow channel 102, and also above the bottom surface 103 of the flow chutes 106, at the start of the welding cycle. This level is below the height of the top of the weir 108. In a second phase of the welding cycle, the level of the molten metal may be raised by the pumping action through the fluid inlets 104 to a level of, typically 12 mm, which is above the topmost height of the weir 108, but below the height of the upper surface 111 of the mold assembly 100.

Each of the flow chutes 106 provides for fluid communication from the flow channel 102 into the mold cavities 112, and raising the level of the molten metal results in the molten metal overflowing the weirs 108. As the liquid flow of the molten metal in the flow channel 102 is raised to a higher level, the side walls of each flow chute 106 direct the molten metal flow along the flow chutes 106 until the liquid flow reaches the weir 108. Weir 108 impedes further flow along the chute and retains the molten metal from continuing further along the channel 106 so it is maintained in the chute 106 without egress to the mold cavities 112. However, as the level of the molten metal continues to be raised until it is above the level of the top edge of the weir 108, the molten metal will overflow the weir 108 and will pour into the mold cavities 112. Of course, the level of the molten metal is inhibited by the pumping controls from rising too high, for example, to a level so high as to approach or overflow the upper surface 111 of the mold assembly 100. However, because the top level of weirs 108 is well below the top surface 111, molten metal can continue to overflow over the edge of the weir 108 without allowing the molten metal level to overflow the mold assembly upper surface 111, which may result in damage to the mold assembly 100 and or causing injury to anyone standing nearby.

Referring to the mold assembly 100 shown in FIG. 6, and also to the schematic detail of a portion of the mold assembly in FIG. 8, the manifold segment 110 is shown directly adjoining the modular mold cavities 112, into which the weirs 108 open. To provide for easier visualization, the detailed schematic view of FIG. 8 will be discussed below, and then the schematically illustrated portion 200 will be discussed as it relates to and in the context of the more complete central portion of the mold assembly 100 shown in FIGS. 6 and 7. It should be understood, that although the schematic model shown in FIG. 8 may provide for an actual construction for a single two mold cavity partial structure, as shown, the view is mostly provided for illustrative purposes to show the operation and structure of the inventive mold cavities and method of heating and cooling thereof. Where sufficient similarities in the elements shown in FIGS. 6-8 exist, identical identification numerals will be used. For example, although the wall structure 105 and island 107 may be somewhat different in shape and orientation, these will be identified by the same numerals throughout the figures.

Figure 13:
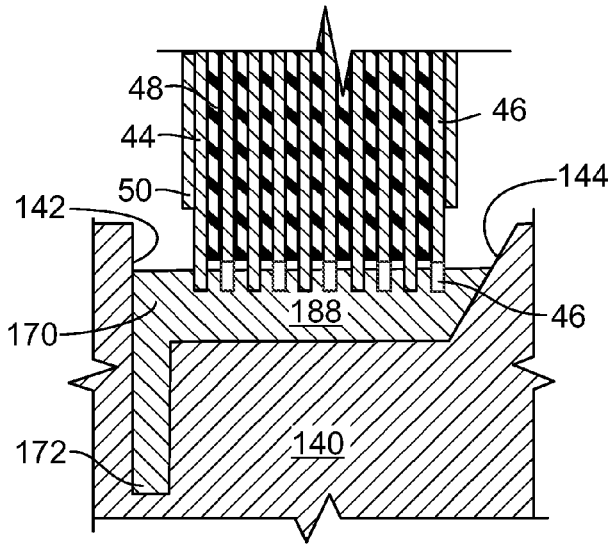
FIG. 13 is a cross-sectional view of the mold cavity according to the present invention, taken approximately along the line 13-13 in FIG. 7, showing the shape and dimensions of the mold used to provide the cast on strap of FIG. 10.

The schematic representation of the mold assembly in FIG. 8, generally identified at 200, includes mold cavities 112 which are defined by a first side wall 132, in which the weir 108 is disposed, by two opposed end walls 142, 144 that are on opposite sides of the generally hexahedral shaped mold cavity 112, the end walls being mostly a part of a central segment 140, and by a second side wall 162 that is a part of a central segment 160. The mold cavity 112 is further defined by a bottom surface 143 extending between the end walls 142 and 144, and which is mostly disposed in the mold cavity segment 140. Tab apertures or wells 121 are shown in profile in FIG. 8, extending below the surfaces 143 of adjacent mold cavities 112. In a typical arrangement, one of the end walls, either 142 or 144, terminates at the bottom surface 143, while the opposite one includes the tab well 121. In the present configuration, adjacent mold cavities 112 include the tab well 121 to be contiguous with the end wall 142 and the adjacent mold cavity 112 to be contiguous with the opposite end wall 142. Thus, the end wall with the tab well 121 is 142 ands the opposite wall is identified as wall 144. Only portions of the end walls 142' and 144' are visible in respect of the mold cavities 112', but the general outline of the connecting tabs 172, to be discussed below with reference to FIGS. 7 and 13, is illustrated. The mold cavity 112 is open toward the top, above the upper surface 111 of the mold assembly 100.

Since the volume of the flow channel 102 and flow chutes 106 are known, the level of the molten metal in the flow channel 102 can be controlled by adjusting the relative pumping capacities of the fluid inlet(s) 104 and the outlet port(s) 109. If the level in the flow channel 102 and the delivery chutes 106 is desired at a higher point, for example, at a height greater than the top edge of the weir 108, the fluid inlet 104 is directed to pump more molten metal into the flow channel 102 and/or the outlet port 109 stops pumping or pumps less. A constant flow of the molten metal through the system may be desirable so as to aid in avoiding coagulation or spur formations of the molten metal in corners or other areas. For speedier control and changes to the internal level of the molten metal in the flow channels 102, several additional fluid inlets 104 (shown in phantom in FIG. 7) may be disposed at appropriate locations in the bottom surface 101 along the flow channel 102, as well as several outlet ports 109 (shown in phantom in FIG. 7) adjacent thereto. The inlets 104 and outlet ports 109 are ideally connected together in manifold configurations and in fluid communication with a molten metal reservoir (not shown) so that the pumping action therethrough operate simultaneously in tandem.

Referring now to FIGS. 6-8, the mold cavity segment 140 is directly adjacent an intermediate segment 130, which is itself adjacent the manifold segment 110. The intermediate segment 130 is shown as being interposed between the manifold segment 110 and the mold cavity segment 140. However, reference to FIG. 6 will show that the intermediate segment 130 extends only partially downwardly into the body of the mold assembly 100, due to its thermal energy input heating power function, as will be described below. Similarly, the central segment 160 also extends only partially down into the body of the mold assembly 100. Both segments 130, 160 also function to maintain the heat input and temperature level of the two respective side walls 132, 162 at desired predetermined levels, as will be described below in greater detail.

It is contemplated and a part of this invention that there will be significant temperature differentials between the various segments 110, 130, 140 and 160. Thus, it is necessary that a planar film or mat 115, comprising an appropriate insulating material, be interposed between each of the adjoining surfaces of any two adjoining segments 110, 130, 140 and 160. Any appropriate thermally insulating material may be utilized, for example, one similar to the heat insulating material described in aforementioned U.S. Pat. No. 4,425,959, or any other appropriate insulating material capable of withstanding high temperatures, typically over 400° C. It is important that the insulating material have a low thermal conductivity so that the thickness of the mat 115 is as small as possible while providing adequate insulating properties between the segments. This will also permit the walls, e.g., 132, 162, of each of the segments, which provide heat transfer capacity directly to the molten metal as needed during operation, to have the maximum possible direct contact with the abutting molten metal in the mold cavity 112. That is, maintaining the thickness of the mat 115 to as small a thickness as possible will minimize the surface area between the segments that is exposed to and comes into contact with the molten metal, but which surface does not provide any heat transfer capabilities due to its low thermal conductivity. Typically, the thickness of mats 115 are in a range of from about 0.005" (0.13 mm) to about 0.100" (2.54 mm), with the preferable thickness being toward the lower end of the range. Of course, different thicknesses of mats 115 may be possible, depending on the battery configurations used.

It should be noted that the bottom surface 143 and end walls 142, 144 are mostly disposed in the mold cavity segment 140, which incorporates between the walls 142 and 144 above surface 143 the majority of the volumes of each mold cavity 112. The mold cavity segment 140 directly adjoins the intermediate segment 130 which is next to the associated manifold segment 110.

Figure 4:
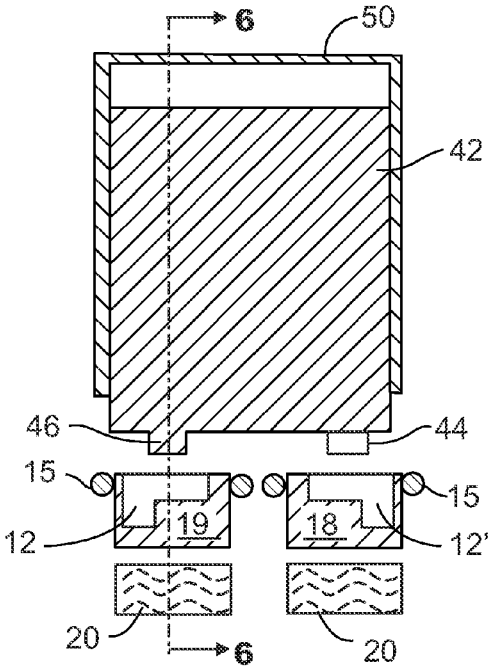
FIG. 4 PRIOR ART
FIG. 4 is a cross-sectional front view of a battery cell configuration with the lugs of a group of battery plates illustrated as being inserted into a mold known in the art.
Figure 5A:
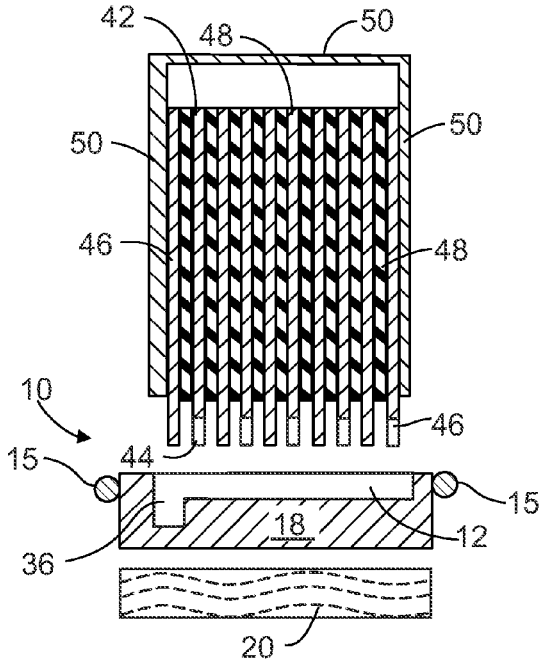
FIG. 5A PRIOR ART
FIG. 5A is a cross-sectional side view of a battery cell configuration taken approximately along section lines 5*a*-5*a* in FIG. 4.
Figure 5B:
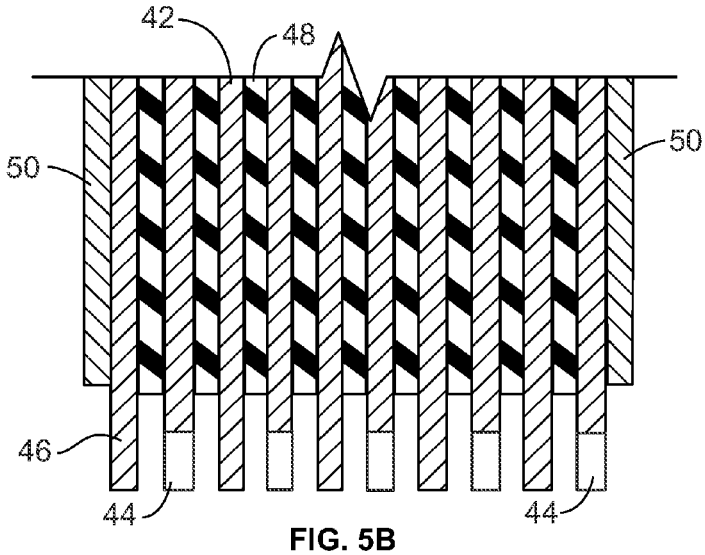
FIG. 5B PRIOR ART
FIG. 5B is a detail of the cross-sectional side view of a battery cell configuration shown in FIG. 5A.

The inventive COS mold assembly 100 utilizes molten metal, or an alloy that is mostly lead, to join the lugs of positive and negative grids or plates of a battery, each pair of which is comprising a cell, together, similar to the known process and structure shown in FIGS. 4, 5A and 5B. For example, in the schematic illustration of FIG. 8, the negative lugs, similar to lugs 44 (FIG. 4) are placed into one set of mold cavities 112 and the positive lugs 46 are placed into the molten metal bath that has been poured into the other set of mold cavities 112' (FIG. 6). This process requires a predetermined amount of thermal energy to form a proper weld between the lugs 44 and 46, and also to one or more battery posts (not shown in FIG. 8). The reduction of the thermal energy input into the system to maintain the lead hot enough to provide good welds while not requiring excessive thermal energy input is a stated goal in the industry, and is met by the present mold assembly configuration, with temperatures rising to the levels discussed above.

The inventive COS mold has essentially three sections, some of which may comprise more than one of the segments described above. For example, intermediate section 130 and manifold segment 110 may be an integral segment, but preferably these are separate so that the higher temperatures may be provided to the flanks of the mold cavities 112. Two of these sections, one comprising the combination of the manifold segment 110 and the intermediate segment 130 are not shown as a single segment section, but can be used in that fashion. When two separate segments are used, the temperatures of the two segments 110 and 130 may be maintained at different levels, for example, the temperature of the manifold segment 110 is maintained at a level sufficient to retain the molten metal in a molten and fluid state, whereas the temperature of the intermediate segment may be maintained at a higher temperature to heat the molten metal to a higher level just before injection into the mold cavity 112. The higher the molten metal temperature as it enters the mold cavity 112, the better able it will be of providing a good weld between the lugs 44, 46 that will be inserted into the mold cavities when the molten metal overflows the top edge of the weir and the molten metal pours into the cavity 112. The other section comprises the mold cavity segment 140 and central segment 160. These two segments are maintained at essentially higher temperatures from that of the third mold cavity segment 140, which mostly contain volume of the mold cavities 112, 112' therein.

The concept of the mold cavity 112 including side walls that are parts of the higher temperature segments is an integral portion of the present invention. The mold cavity volume, and the subsequent molten metal that is poured into the mold cavity, are exposed to the walls 132 and 162, and so provide additional thermal energy input into the cavity and to the molten metal that is poured thereinto. The thermal energy input into the mold cavity provided by the two side walls enhances the heating capacity into the molten metal in the mold cavity in the pouring and welding steps, so that a good weld is provided between the lugs, without the requirement of a large batch or excessive mass of metal in the mold cavities 112, 112'.

Moreover, if additional input of thermal energy is considered necessary, the cavity side walls 132, 162 need not be the only portion of the mold cavity 112 that comprise a part of the two thermally elevated segments 130, 160. As shown in FIGS. 6-8, the side walls 132, 162 do not abut directly on the end of the mold cavity 112, but small portions of the bottom and the end walls are each encroached by additional portions of the segments 130, 160. These take the form of several slices or ledges 146, 166 that each provide a part of the end walls 142, 144 and bottom surface 143, for example, and are immediately adjoining the walls 132, 162. These result in slices 146, 166 that are somewhat triangular in shape but that are part of the thermally elevated segments, to thereby enable additional thermal energy, as needed, to be input into the mold cavity 112. Similarly, a slice or ledge 147 in the bottom 143 of the mold cavity 112 is also part of the intermediate segment, and able to introduce additional heat into the cavity.

Figure 12:
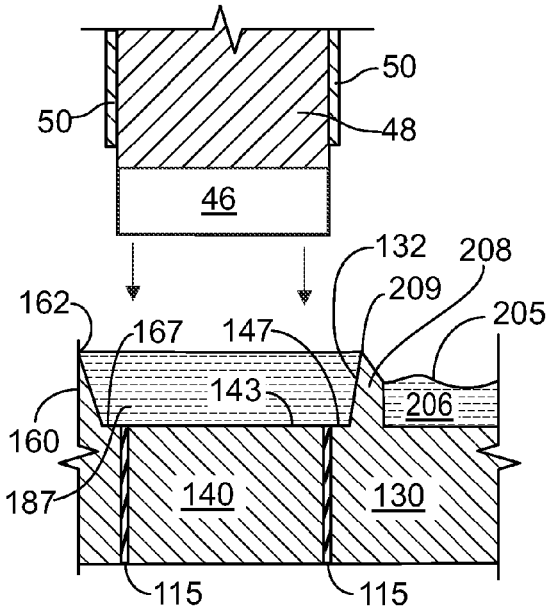
FIG. 12 is a cross-sectional view of the mold cavity according to the present invention, taken approximately along the line 12-12 in FIG. 7, showing the shape and dimensions of the mold used to provide the cast on strap of FIG. 10.

The width, or even the need, for such slices or ledges 146, 166, 147 and 167 depends on the initial planning considerations of the amount of thermal energy that will be needed in the cavity 112 to maintain the molten state of the metal during the lug insertion step. Most clearly visible in FIG. 12, is a similar ledge 167 on the opposite side of the cavity from the ledge 147, ledge 167 being integral with the central segment 160. It will be understood by a person having an understanding of the present invention that the width of the ledges or slices can be varied depending on the desired conditions, the amount of molten metal that may be required for the strap, and other considerations. The ability to provide thermal energy through the side walls 132, 162 and parts of the bottom surface 143 and end walls 142, 144 introduces a flexibility to the configuration that may allow a person having this knowledge to design a configuration to accommodate a particular cast on strap as necessary and to optimize the parameters, thereby to reduce the needed thermal energy input and the amount of lead that is used in the manufacture of the battery.

As shown most clearly in FIGS. 6-8, the two segments 130, 160 flank the third middle segment 140. Separating the sections and thermally isolating the mold segment 140, for example, by including an insulation mat 115 between it and the adjoining segments 130, 160, permits the mold assembly to control the temperature between the segments. The temperature for the manifold segment 110 is kept in a range of from about 420° C. to about 460° C., but more typically is maintained at 450° C. in order that the molten metal will maintain fluid and capable of passing through the trough formed by the flow channel 102. The molten metal is pumped up through the molten metal fluid inlet 104 and along the flow channel 102 and flows toward the molten metal fluid outflow 109. Typically, the molten metal (mostly lead) is drawn up by pumping or other means from a reservoir (not shown) which maintains the metal in a molten state by the continual application of heat during operation. A similar arrangement is described in aforementioned U.S. Pat. No. 4,108,417, and incorporation by reference to the teachings of this patent is made where appropriate to achieve an understanding of that process.

The temperatures of the other segments 130, 110, 140' etc. are also maintained within a predetermined range of specified temperatures. The intermediate segment 130 is maintained at a higher temperature within a range of from about 300° C. to about 500° C., more preferably about 430° C. to about 450° C., the temperature of the central segment 160 is about 200° C. to about 400° C., preferably about 250° C., maintained by an appropriate heating mechanism, such as heating coils (not shown) inserted into throughholes 119. The temperature of the mold cavity segment 140 is maintained at a constant temperature in a range of from 110° C. to 150° C., preferably about 120° C., by a cooling jacket that includes a water inflow port 150 (FIG. 6). The surface temperature of the walls 142, 144 and bottom surface 143 of the mold cavity segment 140 is increased just before the welding step by the pouring in of the molten metal directly from the higher temperature intermediate segment 130, since the molten metal must be maintained hot enough to form a good weld between each of the lugs. As soon as the lugs 44, 46 are dipped into the molten metal by dropping them from above (as shown in FIG. 12), the molten metal begins to be cooled by the water jacket coursing through the aperture 150 causing the metal to solidify, so that a good weld is formed in this casting step. The mold cavity portion temperatures is again reduced to about 120° C. during the casting step in which the molten metal is caused to solidly around the lugs 44, 46.

As described above, the manifold segment 110 delivers molten metal, such as lead, into the mold cavities 112, 112' shown in FIGS. 6-7, essentially by pouring the molten metal through the chutes 106 and the system raising the molten metal level high enough to overflow the weirs 108. While the exposed side walls 132, 162 do add some thermal energy to the metal, the molten metal nevertheless solidifies completely in the mold cavity 112 around the lugs 44, 46 (FIG. 4) despite this continual thermal energy input from segments 130, 160. As has been surprisingly found by the inventors, the heated side walls do not significantly affect the casting process from how it would proceed in the prior art devices, such as shown in FIGS. 1 to 4-5B, despite the cooling not occurring within the complete mold cavity volume. That is, in the prior art, cooling of the complete mold, that is all four of the walls and bottom of the mold cavity, is required to obtain a complete cast on strap. However, the inventive mold cavity configuration provides a solidified strap is by the cooling action only being applied to only the bottom surface 143 and the end walls 142, 144, or the major portions thereof. This cooling action along only portions of three surfaces of mold assembly 100 according to the present invention provides sufficient thermal cooling to completely solidify the strap during the casting process. In the event that additional heating or cooling capacity is needed, additional ports, for example ports 180, for the insertion of heating coils (not shown) or cooling water may be provided, as shown in FIG. 8. The thermal energy input and cooling capacity provided to the system and mold assembly 100 may be controlled remotely and may be monitored by sensors, such as thermocouples, that are placed in contact with the separate surfaces that are required to maintain a predetermined temperature.

Surprisingly, in the inventive mold structure, the cooling jacket which cools only three of the mold cavity surfaces, i.e., the end walls 142, 144 and the bottom surface 143, nevertheless causes the molten metal to completely solidify within the mold cavity 112 as the cooling capacity provided by the cooling jacket is sufficient to cool the entire mass of molten metal in the mold cavity 112. After the weld between the lugs 44, 46 has been established during the step of inserting the lugs 44, 46 into the molten metal, the mold cavity segment 140 reverts to the cooling jacket temperature as cooling water is continually pumped through the cooling jacket to cool off the mold cavity segment to about 120° C. It is considered that the molten metal begins to be solidified at the contact points with the surfaces 142, 144 and bottom surface 143 within the first few moments after the metal is poured into the cavity 112, so that it is important that that the lugs be dipped into the metal immediately after the molten metal is in the mold cavity 112. The required timing of this process further speeds up the cycle and reduces the cycle time.

Since cooling of the molten metal begins almost instantaneously and the thermal energy transfer properties of the metal after initial solidification cools the metal at the lateral side surfaces, which are adjacent the side walls 132, 162, by a heat sink process. The strap surfaces of the cast on strap that are in contact with the side walls 132, 162, being in contact with a heated surface, experience a slower phase transition that leaves the strap surfaces in a slightly more malleable, even though they are in solid form, thereby permitting the easier removal of the cast on straps from each of the cavities 112, 112'.

Another additional benefit of providing or introducing thermal energy into the mold cavities 112, 112' by means of the side wall contact is a marked reduction in the amount of molten metal needed to form a "proper'" weld. The prior art mold designs suffer from the need to maintain the complete mold cavity in a reduced temperature phase, so that when there is an influx of molten metal into the cavity, a large a mount of molten metal, simply to maintain the high thermal energy content, is need to maintain the temperature of the molten metal in the mold cavity sufficiently fluid enough to reach between each of the lugs 44, 46. Any reduction of the amount of molten metal that is poured into the mold cavity would risk the solidification of the metal before it has reached all the necessary lug positions to create a proper weld. In order to avoid this eventuality, the amount of lead or molten metal that is introduced must be above a certain critical level, thereby avoiding the possibility of not providing the necessary contacts between the lugs.

The inventive mold assembly provides significant improvements to those of the prior art fir a number of reasons. Introducing thermal energy into the mold cavities 112, 112' by means of the side wall contact with the thermally elevated (450° C.) side walls of the adjoining intermediate segment 130, 160 provides sufficient thermal energy so as to form a complete weld. Moreover, because the prior art relied on an excess mass of molten metal to retain the fluid properties during the welding step, the thermal energy input from the side walls 142, 144 provides the same function however with a much lesser amount of lead or molten metal required in the mold cavity. The heated side walls 132, 162 of the segments 130, 160 maintain the molten metal at a high degree of fluidity to permit it to flow much more easily between the lugs 44, 46 and form the weld to each of the lugs to a sufficient depth so as to avoid the risk of not making proper contact. The reduction in the amount of lead necessary to complete the weld between the lugs provides for the benefit that less molten metal need be used for each cast on strap, and less thermal energy is required to maintain the molten metal in a fluid state before the pouring step.

Specifically, the amount of molten metal that is needed may be reduced significantly to provide substantial savings in both the lead or molten metal alloy used, as well as the amount of thermal energy required for each cycle. Thus, the mold cavities 112, 112' can be significantly smaller than for a standard strap known in the prior art. For example, it has been found that the width of a conventional strap can be reduced from the standard 22 mm (about ⅞") to only about 15 mm (about ⅝"). The thickness of the strap also can be significantly reduced from about 7 mm (about ¼") to a range of from about 4 mm (about 0.150") to 6 mm (about 0.270"), and preferably between around 4.0 to 4.5 mm (about 0.177"). Reducing the strap thickness allows for the depth of the mold cavity 112 to be reduced from the conventional depth as well, as is evident form a comparison of the cross-sectional views of FIGS. 11 and 13.

Figure 9:
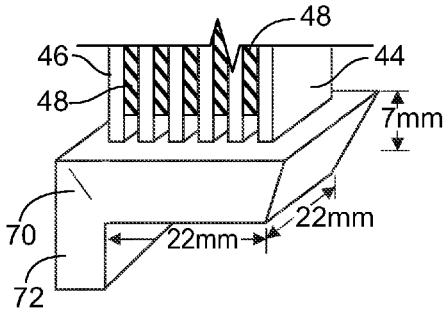
FIG. 9 PRIOR ART
FIG. 9 illustrates a cast on strap made according to a conventional method schematically showing the shape and dimensions thereof.
Figure 11:
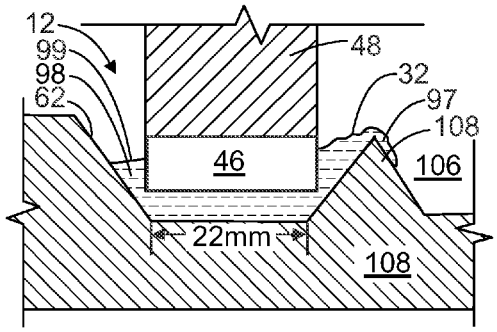
FIG. 11 PRIOR ART
FIG. 11 is a cross-sectional view of a conventional mold cavity and a cast on strap according to the present invention showing the shape immediately following the welding step.

Referring now to FIGS. 9 and 11, a conventional cast on strap 170 is shown having the standard dimensions. The strap body contains the lugs 44, 46 embedded therein, and a tab 172, used for connecting adjacent straps to each other and to the post. As shown in FIG. 11, a molten metal bath was first poured into a standard mold cavity 12, as described above, and the plate configuration, including the plates 42 and lugs 44, 46 and insulating material 48, such as shown in FIG. 5A, was lowered toward the surface 99 of the molten metal 98 in the mold cavity 12 so that the ends of lugs 44, 46 are dipped into the molten metal bath below the surface 99. The difference in temperature between the hot molten metal 98 and the cold lugs 44, 46 causes an immediate decrease in temperature in the molten metal because the lugs also act as heat sinks, withdrawing thermal energy from the molten metal toward the plates above lugs 44, 46. With the current mold design, the temperature of the molten metal drops drastically upon transition from the molten to the solid state. In order for the prior art devices to provide sufficient fluidity to the molten metal 98, a larger mass of molten metal 98 than is ultimately needed for the connections must be poured into the mold cavity 12 so that the metal is maintained hot enough to flow in between the lugs 44, 46 thereby to provide for a good weld and contacting lugs in the cast on strap 170. The standard dimensions are a width of about 22 mm and a thickness of about 7 mm, as mentioned above.

Figure 10:
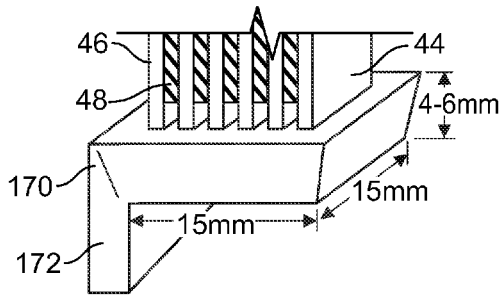
FIG. 10 illustrates a cast on strap made according to the present invention.

The inventive mold cavity configuration results in a different shape to the cast on strap, as shown in FIGS. 10, 12 and 13. The dimensions are capable of being decreased so the width is about 15 mm (about ⅝"), and the thickness of the strap thickness can be reduced to about 4.5 mm (about 0.177") and still provide adequate and consistent mechanical and electrical connections between the lugs on either side for the positive and negative connections. The large volume of molten metal used by conventional molds to provide the connections is not necessary in the invention because not as much molten metal is needed to maintain a temperature that will drive the molten metal to seep between the lugs 44, 46. This result is a direct consequence of the ability to introduce thermal energy into the molten metal in the inventive mold cavity 112 by the direct contact of to the side walls 132, 162, at much higher temperatures than those of the mold cavity segment 140. The compensating factor is that the thermal energy no longer has to be internally contained in the mass of molten metal. The need for excess lead to provide a sufficient amount of thermal energy is no longer necessary, since the thermal energy is input through the molten metal in direct contact with the side walls 132, 162. This capability to provide for precise and controlled temperature management allows for the adjustment of the width of the cavity and the reduced final thickness of the strap.

To further facilitate the removal of the straps from the mold cavities, each of the side walls 132, 162, as well as the end walls 142, 144 of the mold cavities 112, 112' are slanted relative to vertical and diverge in the direction from the bottom 143 toward the mold assembly surface 111. This is conventional to the configuration of the strap after it solidifies, as shown in FIGS. 9 and 11 However, because of advantageous surface qualities imparted to the molded strap by the thermal energy in the two side walls 132, 162, the degree of the slant may also be reduced to provide a more compact shape to the strap. For example, the slant may be reduced form 15° from normal to only 10°, or even as low as 7°, from normal, without affecting the ability to remove the strap quickly and efficiently from the mold cavity. In terms of volume, the amount of savings realized by the reduction of molten metal used in each strap can be as much as one-half, by volume.

To further aid in the removal of the straps efficiently, the two opposed end mold cavities 118 (FIG. 7) having the connector posts, of which apertures 136 are shown, may utilize one, or preferably two offset, ejector pins to push out the post after it has been cast in the aperture 136. Ejector pins are a known method of removing the cast on straps from a mold assembly, but even in this configuration, and these may be utilized in removal of the straps 170 from the mold cavity 112. The inventive feature of heated side walls, 132, 162 which are at the higher temperature, provide a more malleable sliding surface for the strap to be more easily withdrawn, and for the ejector pins to perform their function without much effort.

Another advantage and distinct feature of the inventive mold assembly 100 is the use of the walls 132, 162 that are at a higher temperature further permits the cleaner removal of a completed solidified strap in that the weir is also at the higher temperature. As shown in FIG. 12, the mold cavity is in three separate parts, each part defined by the three segments that provide the surfaces for the mold cavity 112. As the molten metal overflows the alternative embodiment weir 208, and following the cooling of the molten metal to solidify it, the thermal energy in the intermediate segment 130 provides a source of heat to the weir 208, which in turn permits the molten metal to recede directly from the top edge 209 of the weir 208 to flow back to flow chute 206. This breaks off any molten metal that solidifies in the flow chute 206, which is further facilitated by the shape of the weir 208.

As shown, weir 208 includes a sharper edge 209 that causes the flow of molten metal to flow away from the weir 208 when the lugs are brought down and dipped into the molten metal in the mold cavity. As the volume of the lugs displaces the molten metal, it flows back to the flow chute 206. Then as the molten metal is withdrawn from the flow chute 206 by the pumping mechanism (not shown), the overflow remains fluid at the time of solidification of the molten metal in the mold cavity, but remains molten in the parts of the cavity that are a part of the high temperature intermediate segment 130 and thus no overhanging residue results (such as residue 97 shown in FIG. 11 of the prior art devices). This results in a more uniform strap 170 (FIG. 13), and further avoids the waste of excess molten metal.

It should also be noted that the typical or standard width of the lugs 44, 46 is 12.8 mm. While both the prior art and the present invention will accommodate the standard size lugs, the prior art provides a width of 22 mm for the width dimension of the prior art straps 70 (FIG. 11) simply because there must be enough thermal energy in the molten metal to ensure that it flows into the spaces between the lugs to provide the necessary connections. As shown in FIG. 12, however, the same size lugs 44, 46 can be accommodated in a mold cavity that has a width of only 15 mm, since the thermal energy needed to keep the molten metal fluid enough to seep into the tight spaces between the lugs is provided by thermal energy input from the walls 132, 162 or the ledge 147, 167.

It has been further determined that a much sharper edge at the top of the weir, which is further defined by the back wall being a straight vertical wall, can reduce still further the amount of molten metal that can be solidified outside the mold cavity 112. In this alternative embodiment, the mold cavity section is separated from the intermediate segment by an insulation mat, the only major difference between the FIG. 12 and alternative embodiments being in the shape of the back wall. It is considered that the alternative embodiment may be preferable to the other embodiments of the weir, that is, weir embodiments 108 and 208, because the thinner wall can more easily transfer thermal energy from the intermediate segment to the upper edge, and also provide additional thermal energy from the molten metal in the flow chute.

In contradistinction, because the weir is also cooled in the course of the solidification process in a conventional mold assembly, an overhanging residue 97 (FIG. 11) remains behind as the molten metal is withdrawn from the mold cavity 12. Overhang 97 which is often a part of the conventional cast on strap is undesirable as it is utilizing even more excess molten metal.

Weir 208 is shown having a specialized shape to facilitate in the breaking off of any slag or extra molten metal that may be left as part of an overhang, as shown in FIG. 11. However, the benefit derived from the temperature controlled segments having side walls opening onto the mold cavity are also applicable to a weir of more conventional shape, such as weirs 108 (FIGS. 6-8), as long as the weir and the side walls are a part of the first or intermediate segment 130. The heat inherent in the side wall 132 and in the weir 108 would under normal conditions maintain the molten metal in a fluid state even after the solidification of the cast on strap, and the molten metal would flow back toward the flow channel 102 without leaving the overhang on the edge of the weir 108.

Referring now to FIGS. 6 and 7, the schematic view of FIG. 8 is brought into the larger picture of the perspective view of FIG. 6 and the plan view of FIG. 7. Specifically, the detail view showing only two mold cavities 112 and portions of two more cavities 112' is shown in FIGS. 6 and 7 with the other elements of the mold assembly 100 according to the present invention. The two sides, that is, the negative side with the mold cavities 112 and the positive sides with mold cavities 112' of the mold assembly 100 are shown as being essentially mirror images with the central segment 160 separating the two sides. For ease in identification, the negative side elements are designated with identification numerals and the positive side elements are designated by the identical numerals, but with a prime mark, as shown.

The two cavity mold segments 140 and 140' shown in FIG. 6 have an integral construction, with the central segment 160 common to both and comprising an elongated strip having its separate heating element, such as a nichrome wire coil inserted into throughhole 119. This construction permits the two mold cavity sections 140, 140' to have a single water jacket and control operable by means of a throughhole through an aperture 150, thereby enabling the more precise monitoring and control of the temperature of the mold cavity segments 140, 140' by the cooling jacket. Each of the segments 110, 130, 160 include one or more apertures 119 for insertion of heating elements (not shown) that would provide for the separate temperature control of each of the segments.

The configuration of the mold assembly 100 in FIGS. 6 and 7 permits the efficient operation by enabling the lugs 44, 46 that are grouped together to be inserted into each of the mold cavities 112, 112', and including the post cavities 118, 118'. As the level of the molten metal is raised so that it overflows the weirs 108 the plates 142 are dropped down by a unified clamping assembly (not shown) that connects all the clamps 50 (FIGS. 4 and 5A) simultaneously in all of the cavities 112, 112' at one time. The molten metal has already been just poured into the mold cavities 112, 112' when the level is raised by the pumping mechanism (not shown). As the lugs 44, 46 are dipped into the molten metal 98 as soon as it is poured into the cavities 112, 112' (FIG. 12), the excess molten metal now overflows the weir 208 back toward the flow chute 206, and returns the excess to the remaining molten metal 205 in the chute 206, from where it is withdrawn by a lowering of the molten metal level through the outlet ports 109 by the pumping mechanism (not shown).

As described above, the molten metal begins the solidification process as soon as it reaches the cooled surfaces 142, 143 and 144 of the mold cavity segment 140, so timing is crucial as the system must insert the lugs into the molten metal before these becomes solid. Because of the continued thermal energy input from the side walls 132, 162, there is sufficient time in which this is done to still form a good weld between the lugs. The system then remains static for a set amount of time, depending on the size of the mold cavity and other factors, such as lug size, etc. Typically, the amount of time needed to solidify the molten metal will be from about 10 seconds to about 40 seconds, optimally, about 10 to 15 seconds. This cycle time will allow the remaining molten metal in the cavities 112, 112' to solidify and create the strap 170, after which the straps are removed from the mold assembly 100 in unison by the clamping mechanism (not shown) for further processing. Once the clamping mechanism removes the battery assembly, now unified by the straps 170, the mold assembly 100 is ready for the next battery assembly fabrication, including clamping a fresh set of plates 142 with lugs 144, 146 to be placed into the mold assembly 100 for processing. The process is continuous, but with a substantially reduced cycle time since an amount of excess molten metal that must be solidified is eliminated.

The process acts continuously and the steps follow each other in rapid succession, so that cycle time is set by the separate steps in the process. The inventive process significantly less molten metal per strap in the mold cavities, and so the need for a long lag time for the molten metal to solidify is significantly reduced. The reduction in the amount of molten metal, including lead is also reduced to minimize the material costs. Additionally, because only a fraction of the molten metal must be solidified form its molten state to a solid state by the cooling jacket, not as much thermal energy need be wasted in heating up to the melting point all the excess metal that is utilized in the conventional processes.

Other alternative embodiments are possible. For example, while the invention has been shown for the fabrication of a single battery with six positive and six negative mold cavities 112, 112' for a single large battery, a mold construction including several such batteries may be provided so that the process, including the molten metal pouring and simultaneous dipping of the lugs occurs for all of the separate battery molds, one mold 100 of which is substantially shown in FIG. 7. A two battery construction with the two molds as illustrated in FIG. 7 adjoining each other can be calibrated to have the same level of the weir upper edge 209, so that raising the molten metal level in one mold will also do the same for the adjoining mold. Such a structure may have twelve positive mold cavities 112', and twelve negative mold cavities 112 that require lugs to be lowered into them. Other embodiments may a carousel structure, such as those shown in some of the aforementioned patents, and any of these embodiments may utilize the inventive concepts herein, as described in detail above.

The invention herein has been described and illustrated with reference to the embodiments of FIGS. 6-8, 10, 12 and 13, but it should be understood that the features and operation of the invention as described is susceptible to modification or alteration without departing significantly from the spirit of the present invention. For example, the dimensions, size and shape of the various elements may be altered to fit specific battery constructions and applications. Accordingly, the specific embodiments illustrated and described herein are provided for illustrative purposes only and the invention is not limited except by the following claims.

What is claimed is:

1. A mold assembly, including a top surface, for casting cast on straps onto storage battery plates, having lugs along one edge thereof, the mold assembly comprising:

at least one mold cavity for receiving molten metal defined by a first operating temperature controlled segment at a first higher temperature and including a first mold cavity side wall, a second temperature controlled segment substantially defining a bottom mold cavity surface and opposed end walls of each mold cavity, and a third temperature controlled segment at a second operating higher temperature and including a second mold cavity side wall extending essentially vertically from the bottom surface of the bottom wall to a mold assembly top surface, and the temperature of the second temperature controlled segment being maintained at a lower temperature by a coolant jacket in contact with the material comprising the second temperature controlled segment and for providing cooling to the underside of the second segment bottom thereby to cool the bottom mold cavity surface and the opposed end walls, to solidify molten metal flowing in the mold cavity and between and around the lugs of the battery plates inserted into the mold cavity, a respective thermal energy input means for providing thermal energy to each of the first and third temperature controlled segments, including the first and second mold cavity side walls, to input at least a predetermined minimum amount of thermal energy into the mold cavity by the exposure of the molten metal in the mold cavity at least to the first side wall of the first segment having a predetermined temperature higher than that of the lower temperature of the second segment.

2. The mold assembly according to claim 1 wherein the second wall of the third temperature controlled segment further provides a predetermined minimum amount of thermal energy input into the mold cavity as a result of the predetermined temperature of the third segment, higher than the temperature of the second segment, thereby permitting the mold cavity to have increased thermal energy transfer capacity into the molten metal in said mold cavity during a welding phase.

3. The mold assembly according to claim 1 wherein the predetermined operating temperatures of the first segment and the third segment are both greater than the predetermined operating temperature of the second segment.

4. The mold assembly according to claim 2 wherein the predetermined operating temperatures of the first segment and the third segment are both greater than the predetermined operating temperature of the second segment.

5. The mold assembly according to claim 4 wherein the predetermined operating temperature of the first segment is in a range of from 300° C. to 500° C., the predetermined operating temperature of the third segment is in a range of from 200° C. to 400° C., and the predetermined operating temperature of said second segment is in a range of from 110° C. to 150° C.

6. The mold assembly according to claim 4 wherein the predetermined operating temperature of the first segment is about 420° C., the predetermined operating temperature of the third segment is about 250° C., and the predetermined operating temperature of said second segment is about 120° C.

7. The mold assembly according to claim 4 wherein the predetermined operating temperature of said second segment is about 120° C. when the molten metal solidifies and interconnects the lugs, and whereby cooling the molten metal by contact with said bottom surface and end walls of said second segment while providing at least a first side wall with a minimum amount of thermal energy input permits the more efficient removal of the lugs and straps solidified therearound and further permits the mold cavity to have more efficient heat transfer capacity into the mold cavity during the welding phase.

8. The mold assembly according to claim 1 wherein the end walls and the bottom of each mold cavity further comprise at least one end wall slice that is an integral part of the first temperature controlled segment.

9. The mold assembly according to claim 1 wherein an insulating material is interposed between the first and second temperature controlled segments of the mold assembly.

10. The mold assembly according to claim 9 wherein a second insulating material is interposed between the second and third temperature controlled segments of the mold assembly.

11. The mold assembly according to claim 1 wherein the first side wall includes a weir for pouring the molten metal into the mold cavity, and the mold cavity bottom surface closest to the weir has a first ledge that is part of the first segment, and the two end wall portions closest to the weir further each include a slice so that additional thermal energy input can be provided into the mold cavity by the contact with the end wall slices and ledge at the higher temperature of the first segment.

12. The mold assembly according to claim 11 wherein the mold cavity bottom surface furthest from the weir has a second ledge that is part of the third segment, and the two end wall portions furthest from the weir further each include a slice so that additional thermal energy input can be provided into the mold cavity by the contact with the slices and ledge at the higher temperature of the third segment.

13. A method of forming a cast-on-strap on the lugs of a battery plate assembly comprising:

providing a mold assembly having a molten metal flow channel extending to a first height and flow chutes connected to mold cavities, separated therefrom by a weir having a second height lower that the first height, and further comprising first, second and third segments defining a plurality of mold cavities, each of the segments including at least one wall of each mold cavity, the first segment being maintained at a predetermined manifold temperature by a first heating means, the second segment being temperature-controlled and maintained at a mold cavity temperature by a second heating means during a molten metal pouring step, and the third central segment maintained at a predetermined third temperature by a third heating means, the mold assembly further providing a pump for controlling the level of molten metal in the flow channel and flow chutes, activating the pump to raise the level of a molten metal in the mold assembly above the second height but below the first height, such that the molten metal overflows the top surface of the weirs at the end of each flow chute so as result in molten metal being poured into the mold cavity;

lowering the plates of a battery assembly toward the mold assembly, the plates having lugs that are arranged together in groups, each group of lugs comprising a volume that is smaller than the volume of the mold cavity, the lug groups being shaped and oriented for insertion into the mold cavities, terminating the lowering of the plates when at least one end of the lugs are immersed in the molten metal in the mold cavity, welding the lugs of adjacent plates in each group of lugs by solidifying the molten metal therearound to provide an electrical and mechanical connection;

introducing thermal energy from respective heating means into the mold cavity from each of the first, and third segments to input thermal energy into the molten metal during the welding step so that the molten metal flows into spaces defined between adjacent lugs, thereby providing an electrical connection between the lugs within each lug group;

cooling the molten metal in said mold cavity through contact with the mold cavity bottom surface and the end walls of the second temperature-controlled segment wherein the temperature of the molten metal is reduced to about the mold cavity temperature, thereby causing the molten metal to solidify around the lugs in each lug group so as to form a mechanical connection between the lugs within each lug group; and withdrawing the plates and lugs from the mold cavities.

* * * * *